United States Patent [19]

Bowman

[11] Patent Number: 4,867,600

[45] Date of Patent: Sep. 19, 1989

[54] POLYGONAL MANHOLE COVER SUPPORT

[76] Inventor: Harold M. Bowman, 18867 N. Valley Dr., Fairview Park, Ohio 44126

[21] Appl. No.: 201,573

[22] Filed: Jun. 1, 1988

Related U.S. Application Data

[63] Continuation-in-part of Ser. No. 76,668, Jul. 23, 1987, Pat. No. 4,834,574.

[51] Int. Cl.[4] ..... E02D 29/14

[52] U.S. Cl. ..... 404/26; 52/20

[58] Field of Search ..... 404/25, 26; 52/19, 20, 52/21; 49/41, 466, 505; 210/166; 160/374.1

[56] References Cited

U.S. PATENT DOCUMENTS

| | | | |
|---|---|---|---|
| 599,457 | 2/1898 | Sanborn | 404/26 |
| 1,580,541 | 4/1926 | Sherman | 220/301 |
| 1,639,495 | 8/1927 | Frame | 404/26 |
| 1,908,909 | 5/1933 | Manz | 52/19 |
| 1,990,909 | 2/1935 | Lambert | 404/25 |
| 2,109,287 | 2/1938 | Elkington | 404/25 |
| 2,328,068 | 8/1943 | Harris | 220/301 |
| 2,346,361 | 4/1944 | Cupido | 404/25 |
| 2,593,918 | 4/1952 | Redman | 404/26 |
| 2,661,863 | 12/1953 | Howe | 220/301 |
| 2,903,875 | 9/1959 | Bonatz et al. | 52/20 |
| 3,308,727 | 4/1967 | Hurt, Jr. | 404/26 |
| 3,326,100 | 6/1967 | White | 404/26 |
| 3,385,011 | 5/1968 | Sorrell | 52/19 |
| 3,408,778 | 11/1968 | Mason | 52/20 |
| 3,490,177 | 1/1970 | Perron | 49/463 |
| 3,533,199 | 10/1970 | Pickett | 52/20 |
| 3,629,981 | 12/1971 | McCaffery | 52/20 |
| 3,773,428 | 11/1973 | Bowman | 404/26 |
| 3,891,337 | 6/1975 | McCoy | 404/26 |
| 3,911,635 | 10/1975 | Traupe | 52/20 |
| 4,097,171 | 6/1978 | Fier | 404/26 |
| 4,097,228 | 6/1978 | Rosling | 49/466 X |
| 4,225,266 | 9/1980 | Fier | 404/26 |
| 4,269,385 | 5/1981 | Bowman | 249/82 |
| 4,302,126 | 11/1981 | Fier | 404/26 |
| 4,358,084 | 11/1982 | Bowman | 249/82 |
| 4,416,440 | 11/1983 | Bowman | 249/82 |
| 4,440,407 | 4/1984 | Gagas | 277/207 A |
| 4,582,449 | 4/1986 | Vosswinkle | 404/25 |
| 4,582,450 | 4/1986 | Neil | 404/26 |
| 4,637,752 | 1/1987 | Centa | 404/25 |
| 4,648,740 | 3/1987 | Carlson | 404/25 |
| 4,650,365 | 3/1987 | Runnels | 404/25 |
| 4,706,718 | 11/1987 | Milo | 404/26 |
| 4,747,739 | 5/1988 | Bowman | 249/174 |
| 4,763,449 | 8/1988 | Vigneron et al. | 404/25 |

FOREIGN PATENT DOCUMENTS

| | | |
|---|---|---|
| 395078 | 3/1941 | Canada . |
| 588111 | 1/1959 | Canada . |
| 725408 | 1/1966 | Canada . |
| 864247 | 2/1971 | Canada . |
| 446210 | 3/1968 | Switzerland . |
| 336437 | 11/1930 | United Kingdom . |
| 1102946 | 2/1968 | United Kingdom . |
| 2102479A | 2/1983 | United Kingdom . |

*Primary Examiner*—Jerome W. Massie, IV
*Assistant Examiner*—Matthew Smith
*Attorney, Agent, or Firm*—Watts, Hoffman, Fisher & Heinke Co.

[57] ABSTRACT

This cover support provides a seat and lateral keeper for a manhole cover. A principal feature is a plurality of straight lateral segments that are joined near their ends and have corner spreaders acting in an essentially horizontal direction that is biased with respect to the longitudinal axes of the lateral segments whose ends they spread or draw in.

24 Claims, 6 Drawing Sheets

POLYGONAL MANHOLE COVER SUPPORT

REFERENCE TO OTHER APPLICATIONS

This patent application is a continuation-in-part of applicant's U.S. patent application Ser. No. 076,668, filed July 23, 1987, now U.S. Pat. No. 4,834,574, issued May 30, 1989 and entitled *Utility Cover Extension.* The teachings of that application are incorporated herein by reference.

BACKGROUND OF THE INVENTION

This invention relates to adjustable manhole cover supports for emplacing over and raising the grade of an existing manhole cover receiving structure.

For simplicity the terms "existing manhole cover receiving structure" and "manhole cover" herein are used to refer to the existing, i.e., fixed in-place frame or other existing seating receptacle for a removable cover or grating that covers an access hole (i.e., hand hole, tool hole, manhole, catch basin or the like), and that cover or grating ordinarily is intended to bear vehicular traffic. The term "manhole cover support" or simply "cover support" here means a structure that fits over the existing manhole cover receiving structure, raises its grade, and thereby accommodates a cover or grating at the new grade. Advantageously, the cover or grating is the same one that was used at the lower grade. The access hole covered is a utility enclosure serving, e.g., an electric, gas, water, sewer or storm drainage system.

Ordinarily the instant cover support finds its use when a roadway such as a street or highway is resurfaced with an added layer of paving material, typically asphalt concrete, or otherwise is overlaid or repaved to establish a higher grade. It then is advantageous to mount the inventive cover support atop the existing manhole receiving structure. Relevant prior art on manhole cover supports and manhole cover frames can be found in U.S. Pat. Nos. 4,281,944, 4,236,358, 3,968,600, 3,773,428, 4,097,171, 4,302,126, 3,891,337 and 1,987,502. The first four of these are for inventions of the applicant.

Axle loads up to 40,000 pounds must be resisted by many of these cover supports as well as serious impact loads from vehicles and snow plows, a variety of temperature effects, steam leaks, spillage, etc., without permitting a hazardous dislocation of the cover support or its cover. Often it is desirable also to cushion the cover a bit for resisting wear or reducing noise, or to seal the cover and its cover support against a substantial and possibly overloading infiltration of surface water, e.g., storm drainage that otherwise would enter a sanitary sewer system at various manhole locations. Adjustability of the cover support in peripheral dimension and height also is important for accommodating the wide range of specifications to be met.

Clearly the resistance to displacement from traffic loading and impact is a paramount concern and a most general one. The supports often contain some reasonably thin (0.1 inch or less) elements such as sheet steel elements. These can include upwardly projecting cover keeper wall portions, flanging, and bases. Such thin keeper portions can be fitted into an existing manhole cover frame and, normally, still leave a large enough opening at the new-grade to accommodate the same old cover or lid which was used on the existing frame. The lighter weight elements also can be effective for economy and/or ease of manufacture, handling an installation. However, a relatively low weight of the cover support, as compared to the usually thick cast iron fixture on which it is to rest, makes it a candidate for displacement in service. This is true even when a cover support can be expanded against the rising shoulder of a receiving structure such as a manhole cover frame in the manner of various prior art cover supports such as those in U.S. Pat. Nos. 4,281,944, 4,236,358, 4,097,171 and 4,302,126, noted above. polygonal, e.g., quadrangular, cover supports can be especially prone to such displacement. Where the retention is mainly due to the weight of a cover and its support, displacement is even more of a risk.

The instant support can be made especially highly resistant to displacement and dislodgement in service without being made ponderous in weight, even when it has no mechanical fastening to the receiving structure. Thus, while the present cover support can be made to incorporate conventional structural or mechanical holddown means that are integral with it or easily attached, the cover support also can do a good job of holding in (being retained in the existing receiving structure while in service) simply by friction alone, and this not necessarily (but often desirably) with the use of any friction-enhancing retention member.

Additionally, the present support is polygonal and adjustable. It can be adapted readily to sealing off against water infiltration and to cushioning the cover. Furthermore, its stiffness can be made unusually high while its weight can be kept low.

No previously proposed manhole cover supports are known by the inventor to have these very desirable advantages, let alone the capability of combining several or all of them in a cover support in a practical manner.

BROAD STATEMENT OF THE INVENTION

The present adjustable manhole cover support is a polygonal one, often generally oblong or square in plan. It is designed to raise the grade of an existing manhole cover receiving structure. It can be, however, hexagonal, pentagonal, octagonal, triangular, and so on.

It comprises a plurality of straight lateral segments joined near their ends for forming a polygonal perimeter. Each lateral segment has a base with an exterior wall and a collar element that extends upwardly from an essentially flat ledge element. The collar and ledge elements form a lateral keeper and a seat, respectively, for a manhole cover when the lateral segments are assembled. The distance between the adjacent ends of the assembled lateral segments is adjustable by means of a spreader for each corner that is adapted to move the adjacent ends essentially horizontally in a direction which is biased with respect to the longitudinal axes of those segments.

BEST MODE FOR CARRYING OUT THE INVENTION

Figure 1:
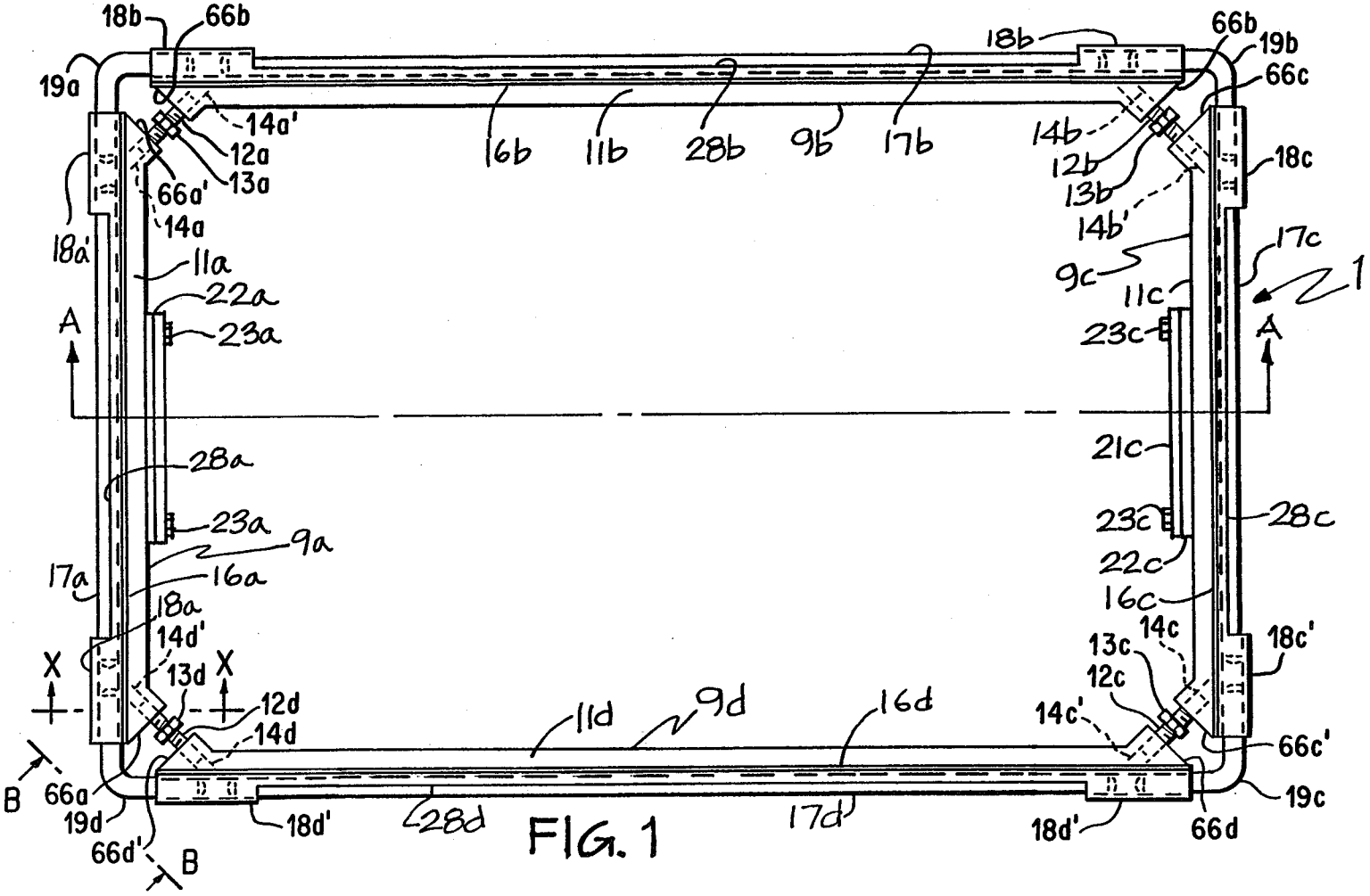
FIG. 1 is a top plan view of a preferred form of manhole cover support made in accordance with invention principles.

Referring to FIG. 1, arrow 1 broadly indicates a preferred embodiment of the instant cover support made to accommodate a nominally 24"×48" rectangular catch basin cover. Such cover normally is perforated or in the form of a grill. The body of the support is made of four straight-sided lateral segments (lateral members) joined at the corners with rods and spreader bolts. The surfaces 11*a*, 11*b*, 11*c* and 11*d* are the ledge elements, i.e., seat portions for the cover. The seat portions form the top of the body's base portions and are made of cast ductile iron, grade 60-45-12. Extending downwardly from the seat portions are the inner wall portions of the bases, specifically 9*a*, 9*b*, 9*c* and 9*d*. Extending upwardly from the seat portions are welded-on sheet steel collar element portions 16*a*, 16*b*, 16*c* and 16*d* acting together as a lateral keeper for the manhole cover. All sheet steel elements are 14 ga. (0.078125").

Figure 3:
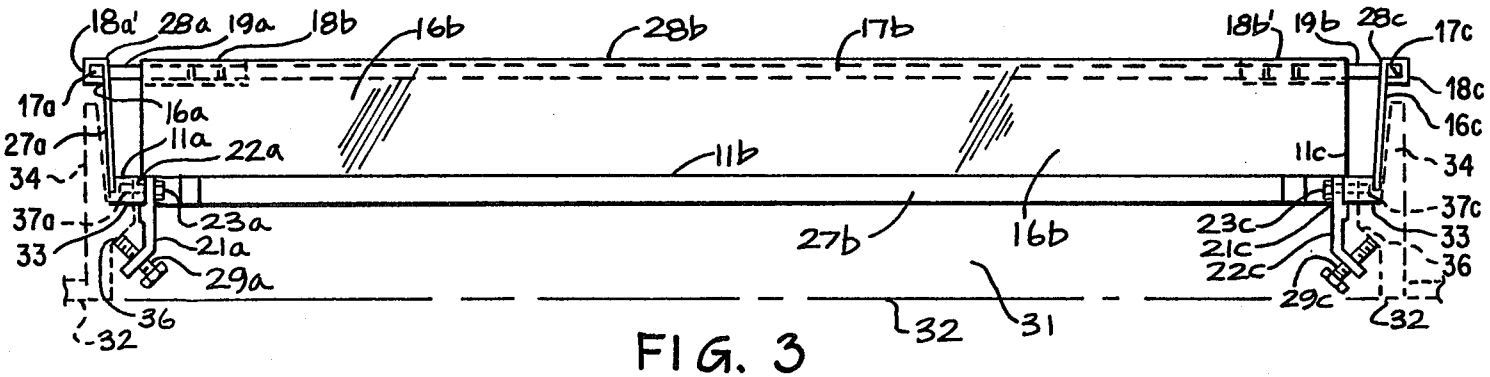
FIG. 3 is a cross-sectional elevation of the cover support of FIG. 1 taken through plane A—A thereof

Tack welded to the outside of the upper rim of the collar element portions are wales (better seen as square cross section steel rods 17*a*, 17*b*, 17*c* and 17*d* in FIG. 3) just under the slight outward flanging 28*a*, 28*b*, 28*c* and 28*d* of the collar elements. These impart ruggedness to the cover support. The ends of these rods fit into sleeves of rectangular cross section at each end of a lateral member, these sleeves being noted as 18*a*, 18*a'*, 18*b*, 18*b'*, 18*c*, 18*c'*, 18*d* and 18*d'*.

The adjustable corners are formed by pairs of opposing jaw surfaces 66*a'*–66*b*, 66*b'*–66*c*, 66*c'*–66*d* and 66*d'*–66*a* that are at the ends of the bases of each segment, each pair being joined by corner spreader bolts 12*a*, 12*b*, 12*c* and 12*d*, respectively. These bolts are threaded on each end with threads of opposite handedness and are driven by cranking their respective hexagonal-faced centers 13*a*, 13*b*, 13*c* and 13*d*. The bolts 12*a*, 12*b*, 12*c* and 12*d* screw into and out of suitably tapped holes 14*a*, 14*a'*, 14*b*, 14*b'*, 14*c*, 14*c'*, 14*d* and 14*d'* in the chamfered end ("jaw") surfaces 66*a*, 66*a'*, 66*b*, 66*b'*, 66*c*, 66*c'*, 66*d* and 66*d'* of the base portions of the lateral members. The longitudinal axes of the bolts are substantially horizontal and enter normal to the chamfered ends, which are mitered to make a 45° angle with the longitudinal axes of the lateral members. The perpendicular distance between the center of the hole tapped for spreader bolt and the contact periphery of the lateral member nearest it that presses outwardly against the existing frame or other receiving structure 15 is 1½ inches. This distance "x" is significant, as will be shown hereinafter. It can be measured in the vertical plane marked as Section "X–X" through bolt 12*d* in the lower left corner of FIG. 1.

Fitting into the sleeves are the ends of bent steel rods 19*a*, 19*b*, 19*c* and 19*d*. The rods make snug slidable fits with the sleeves.

The body also has holddown clamps 21*a* and 21*c* at the inside of the base portion of the two opposite end lateral segments of the cover support. These are spaced outwardly from the base portions by spacers 22*a* and 22*c*, respectively, and bolted the base portions using pairs of nuts 23*a* and 23*c*, respectively. The nuts screw down on threaded lugs projecting from the inside of the base portions of these lateral segments.

Figure 2:
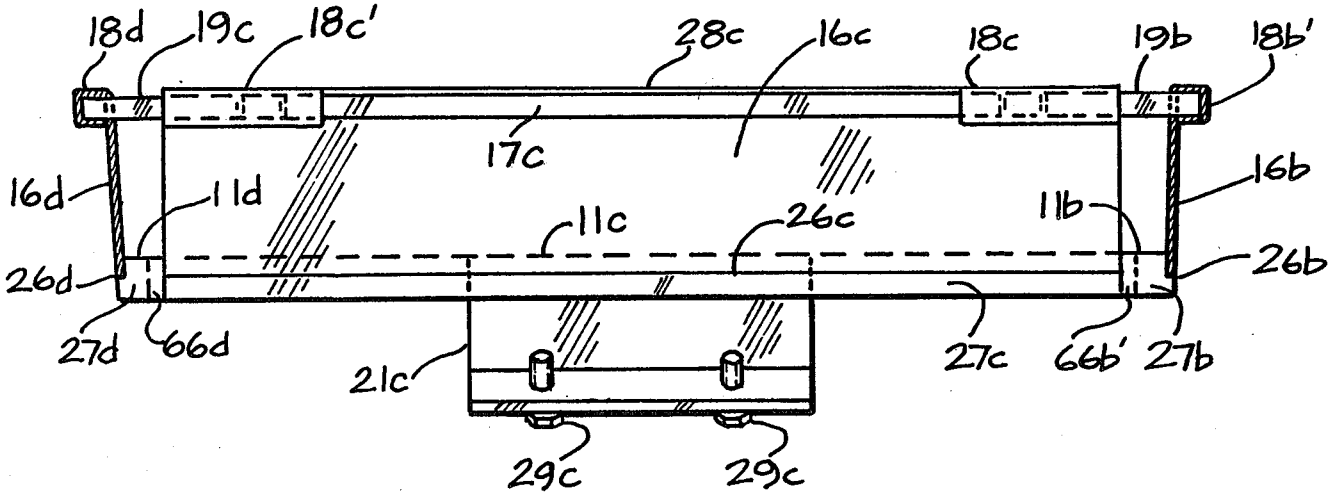
FIG. 2 is a right side elevation view of the cover support of FIG. 1.

FIG. 2 looks at the right end elevation of the cover support of FIG. 1. Collar element portions 16*b*, 16*c* and 16*d* rise with a slight outward slant from the base portions of the cover support. Squared-off end parts of two longer base portions are indicated as 27*b* and 27*d*; these are the terminals of right end surfaces of the two longer lateral segments. It is those chamfered surfaces that are joined to the corresponding end surfaces of base portion 27*c*. The collar elements portions 16*b*, 16*c* and 16*d* are welded to the base portions of the lateral segments to form seams with the base portions, these seams being shown as items 26*b*, 26*c* and 26*d*. The seam between the outer wall of the base portion 27*c* and collar portion 16*c* is particularly evident in this view and is noted as seam 26*c*. The cover seat portions 11*b*, 11*c* and 11*d* actually are the tops of solid base portions 27*b*, 27*c* and 27*d*, respectively. The thinner collar element portions rise at a slight slope to form a small outward flange like that represented by item 28*c*. These small flanges extend between the end sleeves, the sleeves being those represented by items 18*b'*, 18*c*, 18*c'* and 18*d*. Bent steel corner rods 19*b* and 19*c*, often slightly tapered at their ends, fit slidably into the sleeves 18*b*, 18*c*, 18*c'* and 18*d*, while steel rods tack welded to the upper rims of the several collar elements also fit into the sleeves, as indicated by item 17*c* fitting into sleeves 18*c* and 18*c'*. Both kinds of rods here are substantially square in cross section, although it can be of advantage in some cases to taper the bent one appreciably.

Holddown clamp 21c projects downwardly from the inside of base portion 27c and can be forced against an underpart of an existing manhole cover frame with the pair of bolts 29c that are threaded through the bottom of the clamp 21c.

FIG. 3 is a vertical cross sectional elevation of the cover support of FIG. 1 taken through the central plane marked "A—A" thereon. It shows how the cover support is mounted on an existing manhole cover frame 31; the cross section of that frame is indicated entirely in broken lines; it is a single piece of cast iron.

Base portion 27b of the cover support and the other base portions forming the bottom periphery of the support all rest on sill 33 of the frame, which itself rises from its bottom flange 32. These base portions provide the seat for the cover, the seat being indicated in this view by 11a, 11b and 11c. Collar element portions 16a, 16b and 16c, welded to the base portions, rise above retaining rim 34 of the frame and, for the middle of their length, possess a small outward flanging 28a, 28b and 28c. The flanging terminates in sleeves at the ends of the lateral members indicated by sleeves 18a', 18b, 18b' and 18c. Rods 16a, 16b and 16c are welded to fit under the flanging 28a, 28b and 28c, respectively, and project their ends into the sleeves 18a', 18b, 18b' and 18c, respectively. Also projecting into sleeves 18a' and 18b is bent rod 19a, while projecting into sleeves 18b' and 18c is bent rod 19b, both these bent rods being unbonded to the sleeves.

Holddown clamps 21a and 21c are fitted to the inner periphery of base portions 27a and 27c, respectively, with threaded studs 37a and 37c, respectively, projecting through spacers 22a and 22c, respectively, and fastened respectively, by nut pairs indicated by 23a and 23c. The clamps are forced against sloping under ring 36 of the manhole cover frame by use of the bolt pairs indicated by items 29a and 29c.

Figure 4:
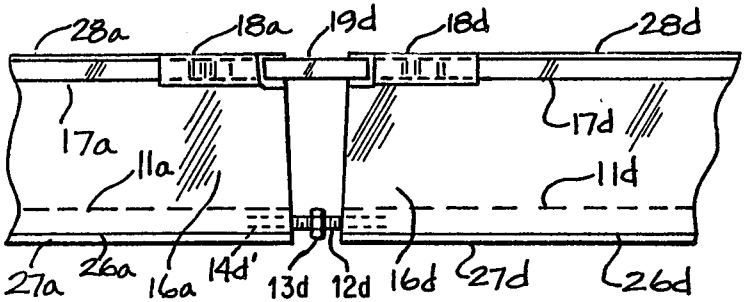
FIG. 4 is a cross-sectional elevation of the cover support of FIG. 1 taken through plane B—B thereof.

FIG. 4 shows the vertical cross sectional view of a corner of the cover support of FIG. 1 through section B—B thereof. Base portions of the steel body of the cover support show as 27a and 27d below seam lines 26a and 26d. Projecting above the seam lines and welded to the base are collar element portions 16a and 16d. The middle rim sections of the collar supports terminate in short outward flangings 28a and 28b while at the ends of collar supports 24a and 24d are sleeves 18a and 18d, respectively. Welded below the short outward flanging are longitudinal rods 17a and 17d; the ends of these project into sleeves 18a and 18d, respectively. Also projecting into the sleeve ends are the ends of bent rod 19d.

Bolt 12d is threaded on each end with threads of opposite handedness. The ends screw into and out of holes 14d and 14d' that are appropriately tapped to make bolt 12d, in effect, a turnbuckle bolt. The middle of bolt 14 has a hexagonal portion suitable for a wrench grip to turn the bolt. Alternatively, the center of the bolt can be studded, notched or perforated for gripping with a lever-like turning tool. Also alternatively, the turnbuckle can be made as two oppositely threaded bolts each pivotally connected to the inside wall of a base portion and connected by a threaded sleeve, usually fairly open at its sides, to be manipulated like the more familiar turnbuckle.

Figure 5:
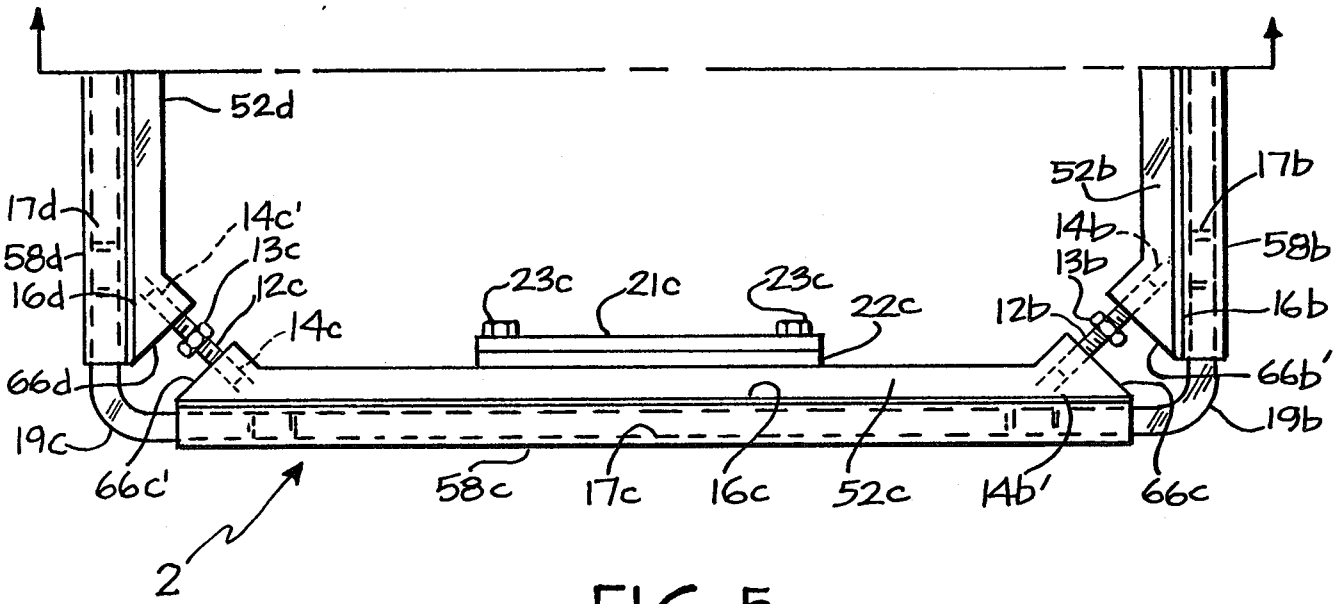
FIG. 5 is a fragmentary top plan view of another preferred form of the manhole cover support generally like that of FIG. 1, but with box flanging running the length of the straight lateral segments and water sealing elements bonded to cover seat portions and outside wall portions of those lateral segments. The sealing elements on the outer wall also act as a cover support retention component when the cover support is expanded against the upwardly extending shoulder surfaces of the existing manhole cover receiving structure such as a manhole cover frame.

The metal body of the embodiment shown in the fragmentary view indicated broadly as cover support 2 in FIG. 5 is essentially the same as the metal body of FIG. 1 except for the following elements: the sleeves 58b, 58c and 58d of FIG. 5 now extend the full length of each straight lateral member and totally encase square rods 17b, 17c and 17d. A rod is under the rim of the end that is not shown; it, too, like rod 17c, is encased by a full-length sleeve not shown, but corresponding to sleeve 58c.

In a less expensive embodiment like the one in this FIG. 5, but not illustrated, the rods 17b, 17c, 17d and its there-invisible corresponding rod to the rear are totally dispensed with. Such rims, hollow or filled with resin, concrete, etc., are highly resistant to bending. The remainder of the metal body elements of FIG. 5 correspond substantially identically to those of FIG. 1; accordingly, they are numbered with the same numbers in both FIGS. 1 and 5.

The other differences between the embodiments of FIGS. 1 and 5 have to do with tough flat, about ⅛" thick foamed elastomer elements that are bonded to the seat and the outer walls of the base and collar element portions of the straight lateral segments. Thus, in FIG. 5 the cover seat portions 52b, 52c and 52d constitute the flat upper surfaces of a coating of elastomer bonded to the flat metal surfaces 11b, 11c and 11d, respectively, which were the cover seat portions in the embodiment of FIG. 1. A like elastomer coating surface forms a seat portion on the end not shown; it, too, corresponds to elastomeric seat portion 52c, bonded to flat steel surface 11c.

Figure 6:
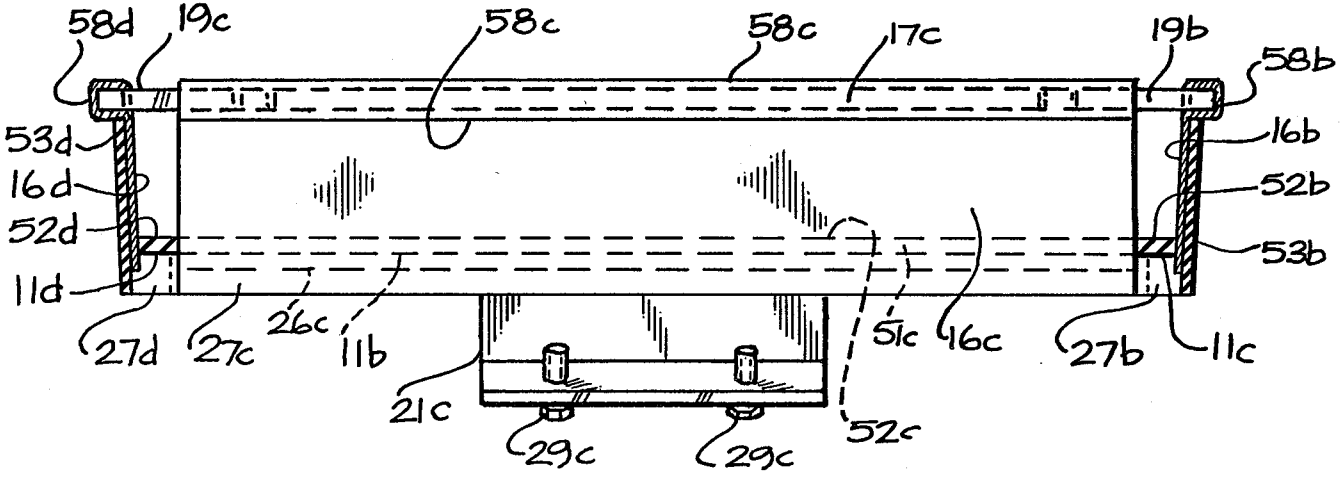
FIG. 6 is a side elevation view of the cover support of FIG. 5.

FIG. 6 is the side elevation view of the cover support of FIG. 5. Sleeve 58c totally encases rod 17c, and sleeves 58b and 58d encase like rods not visible. Bent rods 19b and 19c fit slidably into the ends of the sleeves. The outer walls of the collar elements 16b, 16c and 16d and base elements 27a, 27b and 27c are coated with the same foamed elastomer as the seat portions described in connection with FIG. 5. Those seat portions also are seen in FIG. 6 as items 52b, 52c and 52d. The remainder of the metal body elements of FIG. 6 correspond substantially identically to those of FIG. 5. Accordingly, they have the same numbers.

Expansion of the outer periphery of the cover supports illustrated in FIGS. 1, 2, 3 and 4 can bring tremendous retaining pressure from the outer wall portions, particularly the outer wall portions of the base, against the retaining rim of the existing manhole cover frame or an existing cover support into which the new cover support is fitted. This is due to the corner spreading (as opposed to lengthening the lateral members along their longitudinal axes, a conventional practice less effective for developing this pressure and, thus, the frictional grip of the new cover support in such existing manhole cover receiving structure).

The new cover support embodiment shown in FIGS. 5 and 6 can increase the frictional grip of the cover support of FIG. 1 greatly. This is because the coefficient of static friction between the surface of selected deformable polymers, including many foamed elastomers, and metal surfaces can be much greater than that between two metal surfaces. Thus, the coefficient of static friction in a polymer-to-metal instance should be at least about 0.4, and generally it can be as high as 0.6–0.7 or even more. In a steel-to-steel instance it is unlikely to be as high as 0.35. Shore A Durometer hardness of the polymer composition preferably is at least about 20, and preferably is about 50–70. Usually the thickness of a retention component will be between about 0.4 and 400 mils. Oil resistance can be desirable for them and sealing elements in some installations.

The coefficient of static friction is the ratio of the maximum force parallel to the surface of contact which acts to prevent motion between two bodies at rest in contact with each other from sliding over each other, to the force normal to the surface of contact which presses the bodies together. Thus, the corner spreaders supply a large measure of pressure, and the bonded elastomers heighten friction, thereby making a cover support that is unusually effective for resisting dislodgement or tilting in highway service.

It should be understood that the retention component can be, instead of a full coating, merely a series of dots or lines or other patterns bonded to the exterior of the expandable base of the new cover support. Alternatively such component can be one or more O-rings, continuous bands, a sleeve or a sheet that can be interposed between the exterior of the base and the shoulder of the existing manhole cover receiving structure. The effective thickness of such component should be between about 0.4 and 400 mils. Similarly, the polymer component used to cushion a cover on the new seat can be bonded to or separate from the seat, and be of a continuous or interrupted pattern.

Figure 7:
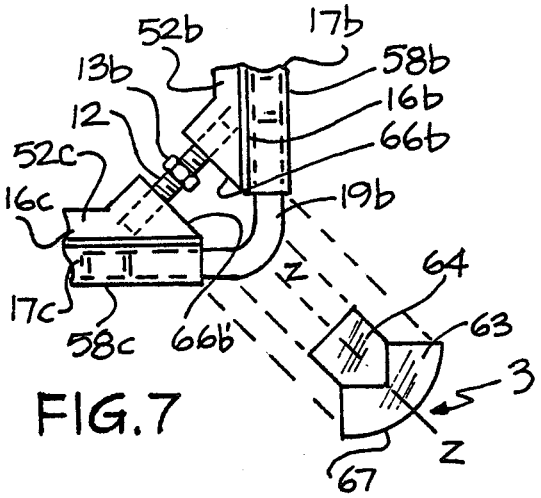
FIG. 7 is a fragmentary plan view of the corner of the cover support of FIG. 5 with its corner joint-sealing fitment removed. The fitment is of foamed elastomer that acts to plug the corner and stop surface water leakage at that point.
Figure 8:
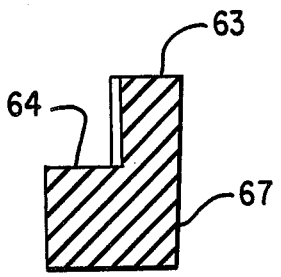
FIG. 8 is a vertical cross-sectional elevation of the fitment taken through section Z—Z of FIG. 7.

FIGS. 7 and 8 depict a way that the cover support of FIGS. 5 and 6 can be further modified to substantially prevent the infiltration of surface water under the cover edges and around the outer perimeter of the new support.

FIG. 7 is the plan view of the right corner of FIG. 5, and outboard of that, indicated by light broken lines, is a water-sealing fitment. The arrow labeled "3" indicates the molded fitment of moderately soft, especially compressible foamed elastomer having Shore A Durometer hardness of about 50–65. Its upper surface 63 at the top of side wall 67 is to fit under the bent rod 19*b*. Seat pad 64 is to fit between the mitered jaws 66 and the ends of seat portions 52*b* and 52*c*. The tip of pad 64 is projectable to just short of the turning path of hexagonal wrench grip 13*b*, and the upper flat portion of such tip is approximately flush with those seat portions; usually it is slightly convexedly arcuate until the corner joint is spread, at which time the cover support makes a tight fit in the existing manhole cover receiving structure and the manhole cover is emplaced on the new seat.

FIG. 8 is a vertical cross section of the fitment taken through plane Z—Z. Upper surface 63 of slightly flaring sidewall 67 is unitary with seat pad 64. With a like fitment plugging each corner to seal the gaps between the coatings of polymer bonded to the seat and sidewall portions, an effective seal is formed against appreciable ground water infiltration around the cover seat and the outer periphery of the new support.

Optionally one side of the fitment of FIG. 7 can be attached to the end of the lateral segment it abuts, e.g., with a water-resisting adhesive or mechanical connection or both. Not shown, but also usable, are one or more short flange or peg elements projecting from the square and/or oblique ends of a pair of adjoining lateral segments into corresponding holes or slot in the vertical sides of fitment 3 or vice versa, going the other way, to help anchor the fitment in place. Also not shown are the expedients of: (a) forming the deformable sealing fitment around a stiffening steel core or armature, typically with the deformable material covering at least those parts of the fitment side wall 67 and/or the seat pad 64 which seal against water leakage around the outer perimeter of the cover support and/or under the cover rim, respectively; (b) stuffing in, and advantageously adhering, a deformable plug-like corner seal from the inside after the cover support is tightened into place; and (c) spraying a sealant into the corner after the cover support is tightened into place. Suitable sealants for this usually are elastomeric. Advantageously they should self-adhere or be adhered to most kinds of surfaces, e.g., with a cement, and advantageously also they can be self-expanding into a dense, closed cell foam upon their emplacement, dispensing or shortly after their in-situ deposition. Typical ones comprise polyurethane or a modified styrene-containing polymer.

Figure 9:
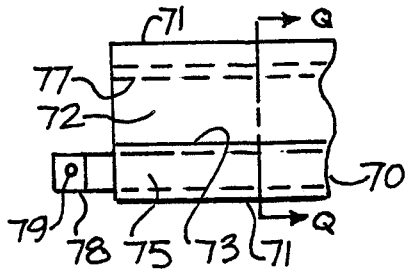
FIG. 9 is a view in elevation of a fragment of the inside of left end of a straight lateral segment of a generally rectangular cover support. It has box flanging at the top of the collar portion. The base also is a box member with a welded-in corner reaction member for providing the tapped bolt hole for one end of the bolt at an adjustable corner joint like the bolt 12*a* of FIG. 1. The segment corresponds broadly to the one at the left side of the top of FIG. 1.

In FIG. 9 the seat, the rise of the collar, the box flanging at the collar top, and the base portions of a straight segment all are formed from a single piece of 18 gauge mild carbon steel to leave an almost squarish hollow channel 79 in the base and a rounded one at top. One edge of the bent steel piece is at the junction 76 and the other at the junction 77, both of which junctions are shown in FIG. 10.

The collar top terminates in rolled box flange 71 extending from the lateral keeper wall 72 of the cover support. Seat 73 is a flattened portion, and the steel continues down to flattened bottom 74. Bottom 74 is to rest on the sill of an existing manhole cover frame. Then it bends upward to form the contact surface against the shoulder of such frame.

Projecting leftward and out from channel 70 is corner reaction member 71. That member is of square cross section with rounded corners to fit snugly into channel 70. There it is fastened securely. This usually includes, for example, resistance welding and/or bolts coming from the inner side wall of the channel as that wall does not have to fit against a frame shoulder or manhole cover. It has a beveled face 78 like face 66*b* of FIG. 1. Into the face 78 is tapped a hole 79 for accepting one end of a turnbuckle bolt like an end of bolt 12*a* of FIG. 1.

Figure 10:
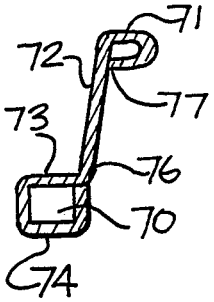
FIG. 10 is a cross sectional elevation taken through Section Q—Q of FIG. 9.

The sheet metal edge junctures 76 and 77 are evident in FIG. 10 (Section "Q—Q" of the segment portion shown in FIG. 9). These junctures can be seam-welded or tack-welded; if that is done it is desirable to fabricate juncture 76 without lumps etc., using grinding if necessary.

Figure 11:
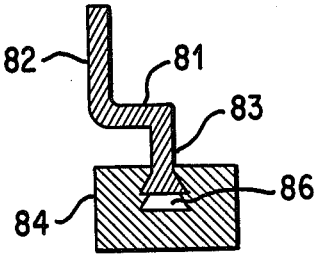
FIG. 11 is a cross sectional elevation of a 2-piece straight lateral segment taken in its middle. The height of the top piece can be adjusted.

The seat of the segment of the all-cast ductile iron cover support depicted in FIG. 11 has corner seat 81 and rising lateral cover keeper 82 as its upper piece. This piece also includes a skirt running downwardly from the seat and terminating in an enlarged lower rim 83 of trapezoidal cross section. These cover supports rarely are made with stiffening flanges or wales.

The rim 83 and skirt fit slidably into complementary cavities in base (lower) piece 84. The lower cavity 86 is shown as being empty and the other one shown as supporting enlarged rim 83. To lower the seat level, the pieces are disengaged and then reengaged using the lower cavity 86 instead of the upper one. More than two such cavities can be superimposed for greater seat elevation adjustment range as is shown in applicant's U.S. Pat. No. 4,281,944. This sort of cover support segment usually is made of cast ductile iron except for any seal and friction-enhancing elements, the cover seat padding, and the bolt, screw and/or rivet elements.

FIG. !2 shows a fragment of a segment of a cover support having a cast malleable iron base 91 onto which is welded collar 96. Topping the collar is a short outward flanging 97. Notch 93 in base 91 has a vertical hole tapped upwardly from the center of its top to accept all the threads and the length to the bolt head of bolt 94 so that the bolt top can be made flush with the rest of the bottom of base 91 if necessary. Unscrewing the bolt adds elevation to the seat. Usually there are at least two and often more such height-adjusting bolts in each segment of a cover support if any are to be used at all. Quite often no elevating means are used at all with a new cover support. Separate shim or gasket-type elements also can be used for elevating the support or for leveling it up.

Figure 12:
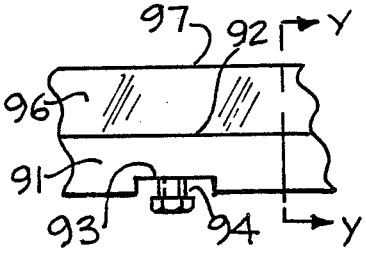
FIG. 12 shows another way for rendering the seat of the cover support adjustable in elevation or for levelling the support. It is a view in elevation of a fragment of the inside middle of straight lateral segment of a generally rectangular cover support. The segment corresponds broadly to the segment at the top of FIG. 1.
Figure 13:
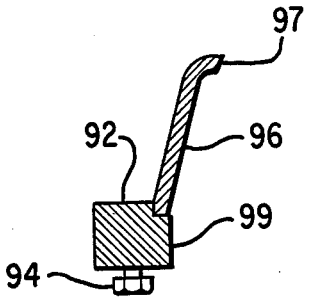
FIG. 13 is a cross sectional elevation taken through Section "Y—Y" of FIG. 12.

FIG. 13, the cross section of FIG. 12 through Section "Y—Y" shows the profile of the segment fragment with the adjustable bolt protruding from the bottom of base 91.

The turnbuckle bolts biased at the corners in accordance with the invention principles impart components of force that are axial to and perpendicular to the straight lateral segments of the cover support that they connect. For the particular bias of 45° relative to the longitudinal axes of the lateral segments as illustrated in FIG. 1, the magnitude of each such component is 0.707 times the bolt force. Positioning these bolts in the same plane as, but at virtually any angle oblique to the corner it connects, i.e., biasing the bolt, is, of course, possible and practical in accordance with this invention. The perpendicular component of force holds the lateral segment directly against the existing manhole frame. The axial component of force, being located inboard from the outer edge of the cover support, provides a bending moment on the lateral segment that actually increases the holding force between the periphery of the cover support and the existing manhole frame.

The conventional positioning of an expansion element such as a turnbuckle or spreading bolt somewhere along the longitudinal axis of the lateral segment, usually in the middle, exerts essentially only an axial force. Also a deleterious bending moment can be imparted to such bolt and segment. The bolt and its segment are apt to bow up, down, or in towards the center of the manhole when especially heavily forced. Accordingly, it can be said that the instant invention makes the bending moment on the bolt work for better retention in the existing frame (or other existing receiving structure) instead of being useless or possibly even deleterious to the cover support.

For the cover support depicted in FIG. 1 the holding force has been calculated to be 26,600 pounds on each side, or a total of 106,400 pounds for the whole support. This compares quite favorably with that estimated for the same size cover support of the conventional (spread at the centers of the lateral segments) design where both cover supports used the same kind of ½" turnbuckle bolts; in such conventional instance the holding force was only 25,000 pounds on each side or 100,000 pounds for the whole support.

The holding forces here for one side of a rectangular cover support can be calculated in accordance with the following formula "F", below, employing inch, pound and degrees of arc units:

$$Hc = \frac{4EA_tB_Tl}{l_B}\,\mathrm{Cos}\theta + \frac{8 \cdot E \cdot A_t \cdot B_T \cdot l \cdot X}{l_B S} \cdot \mathrm{Sin}\theta, \text{ i.e., Formula "}F\text{"}$$

where:

Hc = the holding force in pounds perpendicular to the manhole cover frame (but limited in magnitude by the yield strength of the bolt)

E = Young's modulus of the bolt in pounds per square inch $A_t$ = tensile area of the bolt in square inches $B_T$ = the number of bolt turns after the cover support is seated l = the lead (inches) of the bolt threads $l_B$ = the length of the exposed bolt in inches.

X = the perpendicular distance in inches from the contact periphery of the cover support to the center of the hole that is tapped therein for accepting the turnbuckle bolt S = the length of one side of the cover support in inches $\theta$ = the angle in degrees that longitudinal axis of turnbuckle bolt makes with the longitudinal axis of the side being held against the frame.

This equation, Formula F, can be simplified when the angle $\theta$ is 45° as it is in the embodiment shown in FIG. 1. The equation becomes:

$$Hc = \frac{2 \cdot 2 \cdot E \cdot A_tB_Tl}{l_B}\left(1 + \frac{X}{S}\right), \text{ i.e., Formula } Fs$$

Relative to the foregoing force considerations is the realization that the placing of the turnbuckle bolt can be significant for developing lateral force, the force that is important for cover support retention in highway service. Thus, keeping the bolt hole opening (or the point of entry of a screw protruding obliquely from a side of the cover support into a female-threaded end of a center turning member of the more common turnbuckle bolt) far inboard makes for a higher force value than putting it closer to the contact periphery of the cover support (which contacts and presses against the existing cover frame - or other existing manhole cover receiving structure). The inboard placement of any turnbuckle or like spreader mechanism, of course, permits longer threaded sections and allows for more peripheral adjustment. However, while many manhole covers have a reasonably flat top, they also can have a bottom that is reenforced by ribs, bracing, or like structure hanging down under; these cannot be interfered with, lest the cover won't seat in the newly-installed cover support. Accordingly, there can be a limit to the inboard placement of the spreader.

Advantageously, then, for developing improved retaining force and permitting substantial adjustment with such biased turnbuckle spreader means, the perpendicular distance from the contact periphery of the cover support to center point where the spreader means starts to shorten or lengthen should be at least about one inch and preferably is more, e.g., one and a half inches. Stated another way, as the force is being applied by the spreader to a zone near the end of a segment, that zone can be treated as having a practical center point, and the perpendicular distance from that center point to the contact periphery of the segment should be at least about an inch. The 45° angle biasing tends to develop about equal force in two directions, and this generally is desirable.

Reference is made again to FIG. 6, which displays the bonded elastomer retention component (items **52*b*, 52*c*, 52*d* and has one corresponding to 52*c*** on the side not seen). In tests on related four-segmented manhole cover supports of a different overall shape, but also joined with turnbuckle bolts and having the same kind of adhering foamed elastomer retention component, actually a heat-cured vinyl plastisol retention component, the following interesting fact was revealed: pulling directly upward on the expansible cover support that was held in a ring of steel by only the friction between its elastomer-coated periphery and the ring and its own weight (which was only an inconsequential few percent of the whole load to be pulled) took much more force to remove than a like cover support held the same way in the ring with the same hoop stress exerted, but having no such retention member interposed. The force factor was about 1.38 times as much for the coated support as for the uncoated one.

Suitable polymers that can be formulated for use in the compressible retention component and water seals herein include natural and synthetic rubbers, various vinyl polymers and copolymers such as polyvinyl acetate-polyethylene-acrylic copolymers and polyvinyl chloride homopolymers, polyurethanes, polyesters resins, epoxy resins, styrene-containing copolymers such as ABS and butadiene-or isoprene-styrene copolymers, polyolefins and copolymers containing olefin units and aminoplasts. Plasticizers, pigmentation, stains and/or mineral fillers such as talc, carbon black, etc. commonly are employed in their recipes. The best retention components appear to be elastomeric. Many of them can be foamed and preferably are foamed only very slightly; this can soften them a bit, and it makes them slightly less dense than without foaming. Latent foaming agents reactive upon warming a film of an uncured polymer-providing material coated on a cover support are preferred.

Customarily it is of advantage to prime a metal with a bonding agent or use a bonding treatment to secure the best bond of the retention component or a water seal to metal. Some polymers bond well without this, e.g., epoxy resins. However, the bonds of most are improved by such priming and/or treating.

A preferred foamed plastisol formulation for the retention component of Shore A Durometer hardness about 45–70, and preferably about 50–65, and at least some of the water seals (sprayed on, then heat cured on the metal cover support) is compounded principally from low molecular weight polyvinyl chloride resin plasticized heavily with a conventional phthalate ester plasticizer. It contains minute percentages of stabilizer, red pigment and ozodicarbonamide blowing agent. Another preferred formulation of about the same Shore A Durometer hardness is a rubbery urethane-polyol foam. Some need heat to cure and foam at about room temperature (78° F.). The degree of foaming in both these formulations is very, very small; the bubbles are closed-cell and tiny. In some cases, especially where sealing is to be maximized and strength considerations are secondary, a fair amount of foaming and resulting softened and less dense foamy structure can be tolerated, e.g., Shore A Durometer hardness of 45–55.

In the case of the preferred foamed plastisol that is sprayed on the area to be coated, it is advantageous to spray it onto the hot metal cover support body (370°–380° F.) and let it cure and foam a bit. If extra foaming and/or curing is desired, the coated part can be further warmed at 380°–400° F. for up to a few minutes.

Metal surfaces should be cleaned to accept the polymeric material if it is to be bonded. Then a customary bonding agent such as Chemlok #218 (Manufactured by Lord Corporation, Erie, Pa.) is applied, dried and warmed. Various other useful bonding agents are available such as a Pliobond type (made by the Goodyear Tire and Rubber Company).

As shown above the preferred materials of construction for most of the cover support is ferrous metal, e.g., steel and/or cast iron, particularly cast malleable iron. Other metals can be used where their special properties are desirable and their cost can be tolerated), e.g., stainless steel, high tensile strength steel, wrought iron, bronze, brass, etc. Also suitable in some cases are cover support parts and even much of the main structure fabricated from glass fiber-, aramid fiber-, or graphite fiber-reenforced resin, e.g., a thermosetting polyester or epoxy resin. Means for locking down the cover support to a manhole flange, like the means shown in U.S. Pat. No. 3,773,428, often are desirable in addition to a frictional grip.

Many modifications and variations of the invention will be apparent to those skilled in the art in the light of the foregoing detailed disclosure. Therefore, it is to be understood that, within the scope of the appended claims, the invention can be practiced otherwise than as shown and described.

I claim:

1. An adjustable manhole cover support for emplacing into and raising the grade of an existing manhole cover receiving structure, said cover support comprising a plurality of straight lateral segments joined near their ends for forming a polygonal perimeter, each lateral segment having a base with an exterior wall and a collar element that extends upwardly from an essentially flat ledge element, the collar and ledge elements forming a lateral keeper and a seat, respectively, for a manhole cover when the lateral segments are assembled, the distance between the adjacent ends of the assembled lateral segments being adjustable with an elongated spreader for each corner, each spreader extending to bridge across the adjacent ends of a pair of the lateral segments.

2. The manhole cover support of claim 1 wherein the collar and ledge elements and the base are unitary.

3. The manhole cover of support of claim 2 wherein the base has elevating means for adjusting the heights of the ledge element.

4. The manhole cover support of claim 1 wherein the base is separable from the unitary collar and ledge elements of a lateral segment, and, extending downwardly from the ledge element into the base through a slot therein, is a skirt with an enlarged rim, the rim being slidable into and engageable with any of a stack of like complementary cavity sets that extend outwardly from the sides of the slot for permitting adjustment in the elevation of the ledge element.

5. The manhole cover support of claim 1 wherein the collar elements project outwardly at the top.

6. The manhole cover support of claim 5 wherein the collar elements include a solid reenforcing element at or near their tops.

7. The manhole cover support of claim 5 wherein the top of the collar elements include hollow flanging, and the ends thereof at the corners are joined by a shaft that projects from one end of the flanging of a collar element into the end of the flanging adjacent thereto.

8. The manhole cover support of claim 1 wherein the corner spreaders are screw-operated.

9. The manhole cover support of claim 8 wherein each corner spreader is disposed to apply its force to a zone near the end of a segment, and the practical center of said zone is at a perpendicular distance of at least about an inch from the contact periphery of the cover support with the existing receiving structure.

10. The manhole cover support of claim 8 wherein base ends of the lateral segments terminate to form a flattened jaw therebetween at each corner, and each corner spreader includes a screw whose longitudinal axis is normal to the planes of the corresponding jaw surfaces.

11. The manhole cover support of claim 1 wherein the corner spreader is a parting bolt threaded at both ends, the threads of one end being of opposite handedness to those of the other.

12. The manhole cover support of claim 1 wherein at least the exterior walls of the bases are supplied with a compressible, flexible retention component that is capable of enhancing substantially the frictional grip between the cover support and a previously-installed manhole frame housing or manhole cover support when interposed therebetween.

13. The manhole cover support of claim 12 wherein the retention component is bonded to the exterior walls of the bases, and it comprises a polymer.

14. The manhole cover support of claim 13 wherein the retention component comprises a cured film of plastisol.

15. The manhole cover support of claim 14 wherein the cured film comprises a vinyl plastisol that has been heat-cured.

16. The manhole cover support of claim 12 wherein the retention component comprises a foamed elastomer.

17. The manhole cover support of claim 1 which is quadrangular and has opposing corner jaw surfaces that are mitered to make a 45° angle with the longitudinal axes of their segments.

18. The manhole cover support of claim 1 which has a water seal of compressible polymer that is interposed between its cover seat and the cover it is to accept, and between its outer periphery and the existing manhole cover receiving structure and/or the upper surface into which the cover support is set.

19. The manhole cover support of claim 18 wherein each water seal comprises a foamed elastomer.

20. The manhole cover support of claim 18 wherein the water seals comprise a cured plastisol.

21. The manhole cover support of claim 18 wherein the water seals include corner gap sealing fitments comprising foamed elastomer, and the fitments are disposed between water sealing masses which adhere to the lateral segments.

22. The manhole cover support of claim 9 which is essentially rectangular in plan view, the corner spreaders are turnbuckle means, and the holding force exerted by a lateral segment against the shoulder of an estimated in accordance with Formula F3, $$\frac{2 \cdot 2 \cdot EA_t\beta_T{}^1}{{}^1\beta}\left(1 + \frac{X}{5}\right)$$

23. An adjustable manhole cover support for emplacing into and raising the grade of an existing manhole cover receiving structure, said cover support comprising four straight lateral segments joined near their ends for retaining a rectangular or square manhole cover, each lateral segment having a base with an exterior wall and a collar element that extends upwardly from an essentially flat ledge element, the collar and ledge elements forming a lateral keeper and a seat, respectively, for the manhole cover when the lateral segments are assembled, the distance between the adjacent ends of the assembled lateral segments being adjustable with an elongated spreader for each corner, each spreader extending to bridge across the adjacent ends of a pair of the lateral segments.

24. An adjustable manhole cover support for emplacing into and raising the grade of an existing manhole cover receiving structure, said cover support comprising four straight lateral segments joined near their ends for retaining a rectangular or square manhole cover, each lateral segment having a base with an exterior wall and a collar element that extends upwardly from an essentially flat ledge element, the collar and ledge elements forming a lateral keeper and a seat, respectively, for the manhole cover when the lateral segments are assembled, each resulting pair of adjacent ends forming a mitered joint, the distance between the adjacent ends of the assembled lateral segments being adjustable with an elongated turnbuckle bolt at each corner, each turnbuckle bolt bridging across the pair of the mitered adjacent ends and making screw connections with them.

* * * * *